United States Patent [19]

Eknes

[11] 4,364,606

[45] Dec. 21, 1982

[54] ARTICLES OF FURNITURE

[76] Inventor: Georg Eknes, 5160 Eikangervåg, Norway

[21] Appl. No.: 168,681

[22] Filed: Jul. 11, 1980

[51] Int. Cl.[3] ..... A47C 3/20

[52] U.S. Cl. ..... 297/337; 297/345

[58] Field of Search ..... 297/337, 345, 377

[56] References Cited

U.S. PATENT DOCUMENTS

| | | | |
|---|---|---|---|
| 3,285,656 | 11/1966 | Elfstrom | 297/337 |
| 3,733,104 | 5/1973 | Carstensen | 297/377 |
| 3,989,173 | 11/1976 | Gebhard | 297/377 |
| 4,148,523 | 4/1979 | Brand et al. | 297/345 |

*Primary Examiner*—Francis K. Zugel

*Attorney, Agent, or Firm*—Kenyon & Kenyon

[57] ABSTRACT

Adjustable furniture having a seat and a back and a support component. Two mutually parallel elongate support members on said support component are each passing through a corresponding support sleeve and a downwardly extending slotted opening at the rear side portion of the seat. Said support members extend obliquely upwards at an angle with the horizontal plane of about 30°. A rubber block located at the upper side portion of said slotted opening is providing a friction promoting support of said seat against the associated support member and simultaneously a resilient yielding spring effect between said seat and said support member.

8 Claims, 5 Drawing Figures

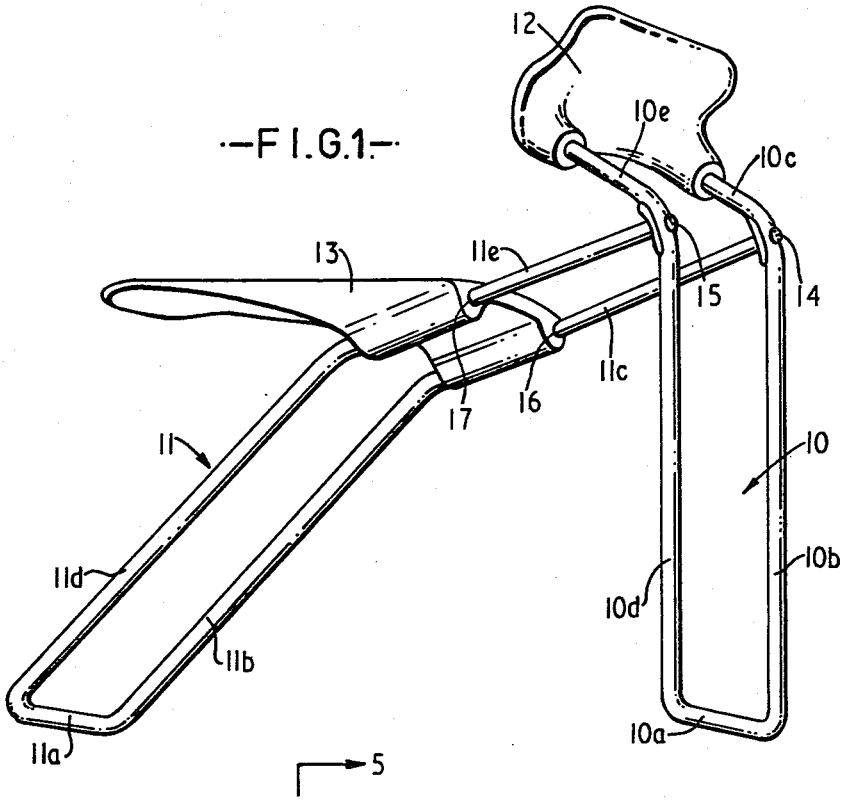
-FIG.1-
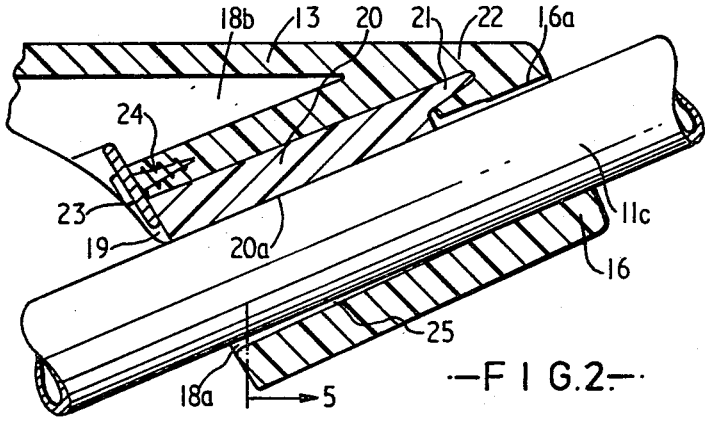
-FIG.2-

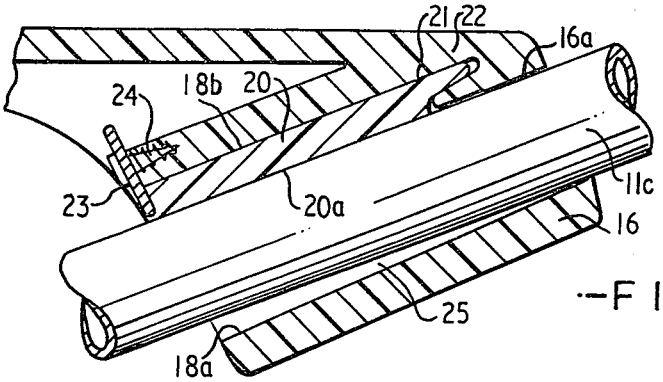
-FIG.3.-
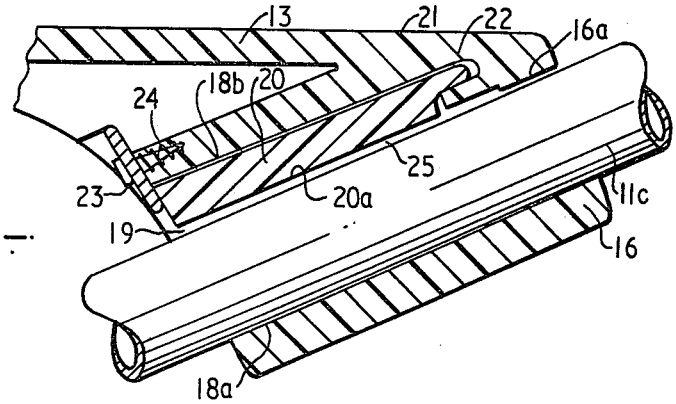
-FIG.4.-
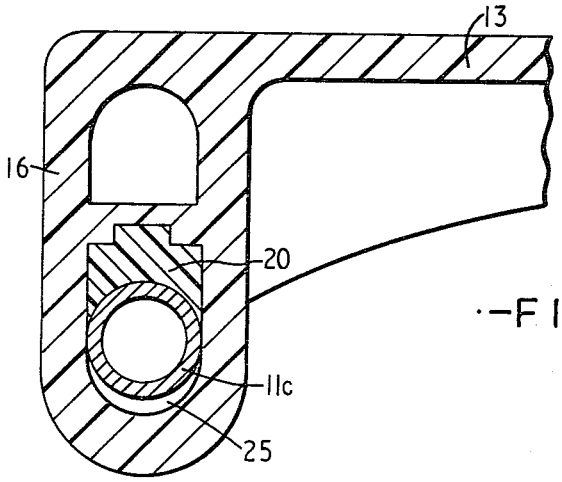
-FIG.5.-

ARTICLES OF FURNITURE

This invention relates to articles of furniture of an adjustable kind, such as chairs, as well as stools and similar furniture. The furniture comprises a support component provided with a pair of backward inclining elongate tubular members for supporting a seat in adjustable positions thereat. At the rear portion of the seat, the tubular members pass through a pair of support sleeves and a pair of slotted openings diverging downwards from the support sleeves. The slotted openings allow the seat to be tilted about a horizontal axis at the rear side portion of the seat by lifting the front side portion thereof.

Norweigan Patent Specification No. 135,118 discloses adjustable chairs in which a seat can be secured at adjustable levels about the ground at obliquely upwards and backwards extending tubular support members by means of support sleeves located at the rear side portion of the seat. The support member is provided with a series of holes at the upper side portion thereof whereas the support sleeve is provided with a peg extending downwards from the upper inner side portion of the sleeve and into one of the holes. When lifting the front portion of the seat, the seat is tiltable in the support sleeve about a horizontal axis at the rear side portion of the seat to such an extent that the peg may be lifted out of engagement with the hole in its associated support member in order to allow the seat to be shifted to another level by repositioning the peg in another hole of the series of holes. The peg is then secured in its associated hole by means of the weight of the seat and will be additionally secured in place by the weight loading exerted on the seat during use.

Such an arrangement involves several disadvantages. Firstly, it is difficult to position the series of holes formed in the support members sufficiently tightly together to enable a fine setting of the chair seat relative to the support members. This is both a functional and economic problem. In addition, the peg has a tendency to scratch up the chromium plate, varnish or other coating on the support members during readjustment of the chair seat on the latter. There is also a problem of metallic noise which occurs readily between the pegs and support members during readjustment of the chair seat as well as during use of the chair.

Thus, there is a need for a simpler constructional solution where the afore-mentioned problems are avoided. The aim is a solution where the readjustment of the chair seat can be effected in, as it were, a step-free manner without metallic noise but, nevertheless, in a way which is gentle with respect to the chromium coating, varnish coating or similar coating of the support members and with the possibility for precise adjustment in a convenient manner. A further objective is the avoidance of metallic noise during use of the chair.

In chairs, such as a chair to be used more or less continuously for a long period of time, there is a need for a resilient connection between the chair seat and its support component to avoid unconvenient local pressure from the chair seat against the thigh portions of the user of the chair. It is a further aim of the present invention to provide such resilience between the chair seat and its support members by incorporating such resilience in a block of an elastically yielding, friction promoting material.

Briefly, the invention provides an article of furniture, such as a chair, which is comprised of a support component, a back and a seat. The support component includes a pair of U-shaped tubular members one of which has a pair of leg portions extending at an oblique angle to a horizontal plane.

The back is secured to the second of the U-shaped tubular shaped members.

The seat is slidably mounted on the obliquely extending leg portions of the tubular member and includes a pair of support sleeves and a pair of elastically resilient blocks. Each sleeve has a respective leg portion extending therethrough and includes a slotted cavity which faces the leg portion. Each block is received in a respective cavity in contact with a leg portion and has a thickness sufficient to provide a spring effect between the seat and the respective leg portion.

The support sleeves are made of a slide promoting material, such as plastic material, to allow the seat to be slid freely along the tubular members with a minimum of friction in an upwardly tilted position of the seat.

The blocks are made of an elastically yielding friction promotion material, such as rubber, and provide a main support surface between the seat and the associated leg portion in a normal downwardly tilted position of the seat.

The invention thus provides a chair of simple support member construction without arresting means as well as a rather simple chair seat construction. The only arresting means and spring means provided in the chair seat are the rubber blocks located in the slotted openings in the chair seat. These simple constructions further provide a smooth readjustment of the seat at its support members in a step-free manner without metallic noise as well as providing better sitting comfort during use of the chair seat.

In order that the invention can be more clearly understood, a convenient embodiment thereof will now be described, by way of example, with reference to the accompanying drawings in which:

FIG. 1 is a perspective view, as seen partly from below, of a chair of the present invention.

FIGS. 2 to 4 are vertical sections showing details of the support of the chair seat at an associated support member in three different positions, i.e. in a normal unloaded chair seat position, in a loaded chair seat position and in an upwardly tilted adjustment position.

FIG. 5 is a view taken on line V—V of FIG. 2.

The chair illustrated in FIG. 1 is a chair of readily dismountable type. The chair is provided with a support component, made up of two U-shaped tubular members 10, 11, and a back 12 and a seat 13. The back and seat are made of plastic material, each cast in one piece.

A web portion 10*a* and 11*a*, respectively, of each of the U-shaped tubular members 10, 11 extends horizontally for supporting the chair against the floor or similar ground surface. A first U-shaped member 10, which forms the back member of the chair, is provided with two L-shaped leg portions 10*b*, 10*c* and 10*d*, 10*e*, i.e. two vertically parallel leg portions 10*b* and 10*d* and two obliquely upwardly and forwardly extending, parallel leg portions 10*c* and 10*e*. back 12 is fastened in a permanent grip at the outer end of each leg portion 10*c* and 10*e*. In the transition areas, i.e. in the bends between the leg portions 10*b* and 10*c* and between the leg portions 10*d* and 10*e*, the U-shaped members 10 and 11 are connected in an easily dismountable manner by means of screw bolts 14 and 15 passing through bores extending transversally of the transition areas and into internal threads of a nut forming fastening means (not shown) secured internally of the outer, upper end of the leg portions 11*b*, 11*c* and 11*d*, 11*e* of the U-shaped member 11. The U-shaped member 11 is provided with first leg portions 11*b* and 11*d* extending obliquely upwards at an angle with the horizontal plane of about 60° and with second leg portions 11*c* and 11*e* extending from the first leg portions obliquely upwards at an angle with the horizontal plane of about 30°.

The second leg portions 11*c* and 11*e* form support and sliding portions for supporting the chair seat 13. Prior to the mounting together of the two U-shaped members 10 and 11, the leg portions 11*c* and 11*e* are pushed through support sleeves 16 and 17 at the rear side portion of the seat 13 and through slotted openings 18 (FIGS. 2 to 5) having opposite side portions 18*a* and 18*b* diverging downwards from an associated sleeve 16 (17). The lower side portion 18*a* has a semicylindrical inner surface in alignment with a central bore 16*a* of the support sleeve whereas the upper side portion 18*b* is provided with a slotted cavity 19 wherein an elastically resilient rubber block 20 is located. The block 20 is provided at its inner end with a tongue shaped extension 21 which is engaged in a corresponding cavity 22 near the support sleeve 16. At the opposite end, the block 20 is secured in its desired position by a clamping plate 23 secured by screws 24 to the support sleeve 16.

The rubber block 20 has a main extension longitudinally of the supporting leg portions 11*c* (11*e*), i.e. an extension or length of from two to three times the diameter of the supporting leg portion 11*c*. The thickness of the block is also of main importance and should be from say $\frac{1}{4}$ to $\frac{1}{2}$ of the diameter of the leg portion 11*d* in order to provide necessary resilience and a desired spring effect when loaded. A rubber quality of from 50 to 80 Shore would be satisfactory whereas a rubber quality of 70 Shore would be preferred. The support surface 20*a* of the rubber block, i.e. the surface 20*a* is arranged to rest against the leg portion 11*c* (11*e*) in unloaded position (FIG. 2) and in loaded position (FIG. 3), and is in the illustrated embodiment provided with a rounded cavity corresponding to the outer surface of the supporting leg portion 11*c*. This cavity is more or less in alignment with the upper half of the bore of the sleeve 16. However, a spacing 25 is provided between the support surface 20*a* of the rubber block 20 and the inner portion of the sleeve 16. This spacing 25 easily enables the support surface 20*a* of the rubber block 20 to be tilted completely out of engagement with the leg portion 11*c* when tilting the chair seat into the position illustrated in FIG. 4, and the seat is free to be readjusted to different positions along the supporting leg portion 11*c* (11*e*). However, as soon as the chair seat is released from the position illustrated in FIG. 4, it drops into the position illustrated in FIG. 2 and instantaneously provides a frictional grip between the surface 20*a* and the abutting leg portion surface. When additional load is exerted on the chair seat during use thereof, an additional frictional grip will be exerted between the two surfaces, and simultaneously the rubber block will be compressed gradually according to the load exerted on the chair seat. If the user exerts additional load at the outer front end of the chair seat, this will again compress the rubber block additionally, and the user may obtain a certain adjustment of the tilting degree of the chair seat in relation to the chair support component. This tilting adjustment is based on a spring effect incorporated in the rubber block.

I claim:

1. An article of furniture of an adjustable kind, such as a chair, especially a child's chair, as well as a stool and similar furniture, comprising a support component provided with a pair of backward inclining elongate tubular members for supporting a seat in adjustable positions thereat, whereas at the rear portion of said seat said tubular members are passing through a pair of support sleeves and a pair of slotted openings diverging downwards from said support sleeves, which slotted openings are allowing the seat to be tilted about a horizontal axis at the rear side portion of the seat by lifting the front side portion thereof, characterized in that the support sleeves are made of a slide promoting material, such as plastic material, for allowing the seat to be slided freely along said tubular members with a minimum of friction, in an upwardly tilted position of the seat, and that the upper side portion of said slotted openings spaced from said support sleeves is provided with a block of elastically yielding, friction promoting material, such as rubber, and said block is providing a main support surface between said seat and its associated tubular support member and of sufficient thickness to provide a spring effect between said seat and its associated tubular member, in a normal downwardly tilted position of the seat.

2. An article according to claim 1, characterized in that said block is made of rubber of from 50 to 80 shore, by preference about 70 shore.

3. An article according to claim 1, characterized in that said block has a thickness radially of the support member of from $\frac{1}{4}$ to $\frac{1}{2}$ of the radial thickness (diameter) of the support member.

4. A chair comprising a support component including a pair of U-shaped tubular members, one of said members having a pair of leg portions extending at an oblique angle to a horizontal plane;

a back secured to the other of said members; and a seat slidably mounted on said leg portions of said one tubular member, said seat including a pair of support sleeves and a pair of elastically resilient blocks, each said sleeve having a respective leg portion extending therethrough and including a slotted cavity facing said leg portion and each said block being received in a respective cavity in contact with a respective leg portion with a thickness sufficient to provide a spring effect between said seat and said respective leg portion.

5. A chair as set forth in claim 4 wherein each sleeve is spaced from a respective leg portion to permit tilting of said seat relative to said leg portions for sliding along said leg portions with said blocks out of contact with said leg portions.

6. A chair as set forth in claim 4 wherein each said block is made of rubber of from 50 to 80 Shore.

7. A chair as set forth in claim 4 wherein each said block has a length of from two to three times the diameter of said respective leg portion.

8. A chair as set forth in claim 4 wherein said thickness is from $\frac{1}{4}$ to $\frac{1}{2}$ the diameter of said respective leg portion.

* * * * *